United States Patent [19]

Schippers et al.

[11] Patent Number: 4,585,181

[45] Date of Patent: Apr. 29, 1986

[54] YARN TRAVERSE APPARATUS

[75] Inventors: Heinz Schippers; Erich Lenk, both of Remscheid; Herbert Schiminski, Huckeswagen; Herbert Turk, Remscheid, all of Fed. Rep. of Germany

[73] Assignee: Barmag Barmer Maschinenfabrik AG, Remscheid, Fed. Rep. of Germany

[21] Appl. No.: 745,273

[22] Filed: Jun. 14, 1985

Related U.S. Application Data

[63] Continuation-in-part of Ser. No. 694,952, Jan. 25, 1985, Pat. No. 4,561,603.

[30] Foreign Application Priority Data

Jun. 16, 1984 [DE] Fed. Rep. of Germany ..... 3422529
Aug. 30, 1984 [DE] Fed. Rep. of Germany ..... 3431838

[51] Int. Cl.[4] ..... B65H 54/28
[52] U.S. Cl. ..... 242/43 A
[58] Field of Search ..... 242/43 A, 43 R, 43.1, 242/43.2

[56] References Cited

U.S. PATENT DOCUMENTS

| | | | |
|---|---|---|---|
| 3,374,961 | 3/1968 | Otsuka et al. | 242/43 A |
| 3,489,360 | 1/1970 | Torsellini et al. | 242/43 A |
| 3,650,486 | 3/1972 | Hasegawa et al. | 242/43 A |
| 3,659,796 | 5/1972 | Bucher et al. | 242/43 A |
| 3,861,607 | 1/1975 | Schippers et al. | 242/43 R |
| 4,165,047 | 8/1979 | Mackie | 242/43 A |
| 4,505,436 | 3/1985 | Schippers et al. | 242/43 A |
| 4,505,437 | 3/1985 | Schippers et al. | 242/43 A |

FOREIGN PATENT DOCUMENTS

| | | | |
|---|---|---|---|
| 0114642 | 8/1984 | European Pat. Off. | 242/43 A |
| 1710068 | 5/1967 | Fed. Rep. of Germany . | |
| 3243985 | 5/1977 | Fed. Rep. of Germany . | |
| 3404303 | 8/1985 | Fed. Rep. of Germany | 242/43 A |
| 1541176 | 1/1974 | France . | |
| 7212898 | 1/1962 | Japan . | |
| 46-16298 | 3/1971 | Japan . | |
| 6517090 | 1/1974 | Japan . | |
| 7137025 | 7/1983 | Japan . | |
| 1168893 | 10/1964 | United Kingdom . | |

*Primary Examiner*—Stanley N. Gilreath
*Attorney, Agent, or Firm*—Bell, Seltzer, Park & Gibson

[57] ABSTRACT

A yarn traverse apparatus is disclosed for winding a running yarn onto a rotating package, and which includes a first traverse means comprising a guide rail, and a pair of oppositely rotating arms mounted for rotation about closely adjacent parallel, or coaxial axes. A second traverse means is also provided which comprises a grooved roller positioned between the first traverse means and the yarn package being wound. In order to achieve a precise guidance of the yarn onto the package, the first yarn traverse means defines a guide stroke which extends beyond each of the ends of the traverse stroke defined by the grooved roller. In addition, the guide rail and/or the arms include means for guiding the yarn adjacent each of the ends of the guide stroke such that the yarn is free to rapidly rebound a short distance toward the center of the stroke, and is then restrained during movement through a second traverse distance.

8 Claims, 5 Drawing Figures

YARN TRAVERSE APPARATUS

This is a continuation in part of copending application Ser. No. 694,952 filed Jan. 25, 1985 now U.S. Pat. No. 4,561,603.

The present invention relates to a yarn traverse apparatus for use on a yarn winding machine for reciprocating the yarn transversely to its running direction over a predetermined traverse stroke and to thereby wind the running yarn onto a rotating package.

Yarn traverse apparatus are known wherein a pair of oppositely rotating guide arms are employed to convey the yarn in each traversing direction, note for example German OS No. 17 10 068. U.S. Pat. No. 3,861,607 discloses a winding apparatus which includes two yarn traverse devices, namely a reciprocating thread guide as the first device, and a grooved roller as the second device. In that construction, a reliable guidance of the yarn is provided in that the laws of motion are specified for the two yarn traversing devices, which laws provide that the stroke lengths are substantially the same and that the first yarn traverse device, although being temporarily accelerated before or after the stroke reversal, is operated at the stroke reversal with only a slight change of speed, whereas the path of the grooves of the grooved roller produce a sudden change of speed at the stroke reversal. The two yarn traverse devices of the cited U.S. patent provide a precise guidance of the yarn onto the package, and the law of motion provided by the devices of such patent is believed to be suitable for any traverse device used as a first traverse device. However, using a traverse device as shown in German OS No. 17 10 068, which has oppositely rotating guide arms as a first traverse device, it has been found that another law of motion for the first traverse device may be employed which also ensures a precise guidance of the yarn onto the package.

It is accordingly an object of the present invention to provide a yarn traverse apparatus which comprises two separate traversing devices, with the first device comprising a pair of oppositely rotating blades, and which is adapted to achieve a precise guidance of the yarn onto the package being wound.

These and other objects and advantages of the present invention are achieved in the embodiment disclosed herein by the provision of a yarn winding apparatus which comprises a spindle adapted to coaxially mount a tubular yarn bobbin, drive means for rotating the bobbin and the package being formed thereon, a first yarn traverse means which includes a guide rail and a pair of guide arms mounted for rotation in opposite directions, and a second yarn traverse means which comprises a guide roller mounted between the first yarn traverse means and the package being wound, and with the guide roller having grooves formed in the surface thereof for guiding the yarn onto the package. In accordance with the present invention, the first yarn traverse means is constructed and arranged such that the guide stroke defined by the first traverse means extends beyond each of the ends of the traverse stroke of the yarn defined by the guide roller. In addition, it is preferred that the first yarn traverse means further include means for guiding the yarn adjacent each of the ends of the guide stroke and such that the yarn advances along a relatively short initial traverse distance from the end of the stroke toward the center of the stroke at a speed greater than the advance speed along the remainder of the stroke.

The present invention further provides that the guide rail and oppositely rotating arms of the first traverse means are designed such that upon the yarn reaching the end of the guide stroke, it is accelerated in the opposite direction so as to reverse its direction of movement and so that it is returned at a very high acceleration and speed, and thereby moves in front of the entry point of the groove on the roller at approximately the angle at which the yarn is placed on the package. The yarn is then guided through the central area of the guide stroke at substantially the traversing speed of the grooved roller, whereas in U.S. Pat. No. 3,861,607 the first yarn traverse system is operated at the reversal points of the stroke with little change in speed, and before and/or after the reversal points of the stroke temporarily at a higher speed than the speed along the central area of the traverse stroke. It has been found that when a rotary arm traversing system is employed, the rotary arm system is able to reverse the yarn at the reversal points of the strokes at a very high speed. Theoretically, the rotary arm system is able to achieve an infinitely high change of speed in direction of movement of the yarn, and return the yarn at an infinitely high speed in a direction toward the center of the traverse stroke, thus insuring a precise guidance of the yarn into the grooves of the grooved roller.

It is known that the desired law of motion provided by the first yarn traverse system may be achieved by suitably shaping the guide rail and the rotary arms, note for example British Pat. No. 1168893. Preferably, this shaping is provided in the reversal areas of the stroke, so that the yarn is guided at the speed which corresponds to that maintained in the central area of the stroke, to the end of the guide stroke. Thereafter, the yarn is reversed at a very high acceleration, and is then again returned to the law of motion maintained in the central area of the traverse stroke to such an extent that the yarn moves at the angle of displacement defined by the entry point of the groove of the roller. In a preferred embodiment of the invention, the return of the yarn may also be achieved in that the rotary arms and the guide rail are shaped so that the forced guidance of the yarn is temporarily released upon reaching the end of the guide stroke, so that the yarn is able to rebound under its own tension in accordance with the law of motion predetermined by the grooves of the roller.

In accordance with the present invention, and in contrast to the embodiment of German Patent OS No. 17 10 068, the yarn preferably does not drop out of the grooves of the roller, but is so guided by the first yarn traverse system, that this will not occur. To accomplish this result, a substantial overstroke is preferred at each end, with the overstroke at each end preferably being equal to at least about L times tangent alpha, wherein L equals the shortest distance of yarn travel between the guide arms and the yarn contact point on the roller, and alpha equals the angle between the yarn on the package and a tangent line perpendicular to the axis of the package.

Some of the objects and advantages of the present invention having been stated, others will appear as the description proceeds, when considered in conjunction with the accompanying drawings, in which FIG. 1 is a end sectional view of a yarn winding apparatus embodying the features of the present invention;

Figure 1:
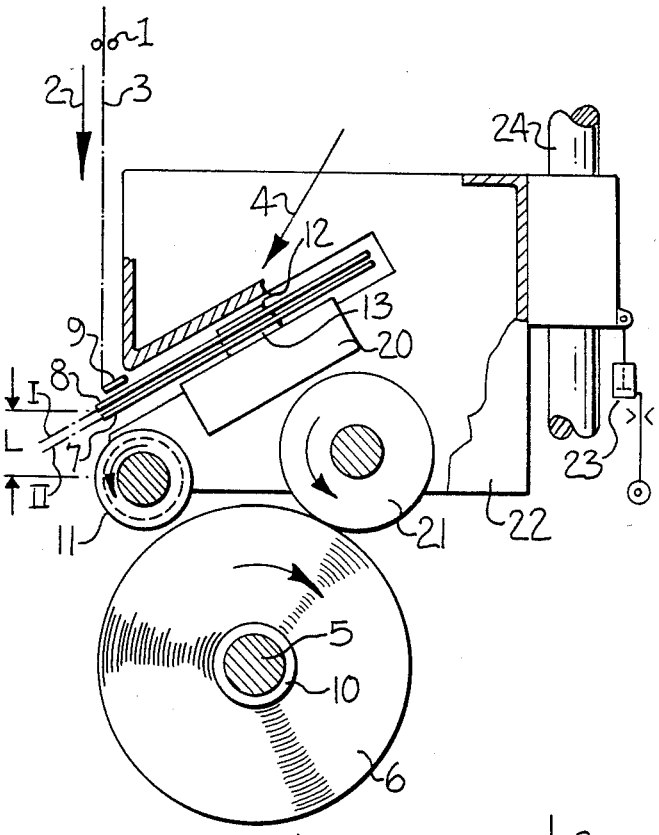

Referring more particularly to the drawings, FIG. 1 schematically illustrates a yarn winding apparatus wherein a yarn 3 runs in the direction of arrow 2, through a stationary yarn guide 1, and then to a yarn traversing system 4. A spindle 5 is mounted for free rotation on the apparatus, and an empty tubular bobbin 10 is coaxially placed on the spindle 5 at the beginning of the winding operation. The yarn 3 is advanced at a constant speed, and may comprise for example newly spun and/or drawn man made fibers. The yarn passes through the traversing system 4 and is wound on the empty bobbin 10 to form a cross wound package 6. The bobbin 10 and package 6 are rotatably driven by the contact drive roll 21 at a constant circumferential speed. The yarn traverse system 4 and the drive roll 21 are both mounted on a slide 22, which is adapted to move vertically up and down along guide rods 24, so that the drive roll 21 can accommodate the build or increasing diameter of the package 6. The weight of the slide 22 may be partially supported by a supporting means 23, which is in the form of a cylinder-piston assembly in the illustrated embodiment. Further, the supporting means can be so controlled that the slide and the drive roll 21 may be lifted from the circumference of the package to facilitate doffing.

The yarn traverse system 4 comprises a first yarn traverse means which includes a guide rail 9 which extends in a direction generally parallel to the axis of the spindle 5, and a pair of guide arms 7 and 8 mounted for rotation in opposite directions about closely adjacent or coaxial axes, and so that the rotating arms define closely adjacent parallel planes I and II. Also, the extremity of each rotating arm is adapted to pass through the yarn path of travel and along the guide rail and so as to reciprocate the yarn along a guide stroke. The yarn traversing system 4 further includes a second yarn traverse means which comprises a guide roller 11 mounted between the first yarn traverse means and the spindle 5 and generally parallel to the axis of the spindle 5. The guide roller 11 has grooves formed in the surface thereof as best seen in FIG. 2, for guiding the yarn onto the yarn bobbin mounted on the spindle 5 and while traversing the yarn along a traverse stroke to form the cross wound package 6.

The yarn traversing system 4 has a common drive which is shown schematically in FIG. 1, and so that the rotary arms and the grooved roller are operatively interconnected. A particular advantage of the illustrated traversing system is the fact that the angle at which the yarn is placed on the package, may within limits deviate since the traversing speed can be adjusted independently of the winding speed. For example, it is possible to permit the traversing speed to fluctuate about a mean value for the purpose of avoiding ribbons, or to temporarily change the speed to a closely adjacent value upon the approach of a ribbon.

The rotary guide arms 7 and 8 are mounted on rotors 13 and 12 respectively, and the rotors may be supported in a concentric or eccentric relationship to each other. Both rotors are oppositely driven by a drive and gearing (not shown) which is mounted in the casing 20. The rotor 12 may accommodate two, three, or four rotary arms 8 which rotate in the plane I and in the direction 18, while the rotor 13 may accommodate the same number of arms 7 which rotate in a closely adjacent plane II in the direction of arrow 17. The rotary guide arms guide the yarn along the guide rail 9, with each arm 8 transporting the yarn (FIG. 2) to the right and transferring it at the end of the guide stroke to the arm 7. The arm 7 in turn transports the yarn in the opposite direction to the other end of the guide stroke, where again one of the arms 8 engages the yarn to return it to the right end. Further details regarding rotary guide arms of the described type may be obtained from EPO published application No. 0 114642, German OS No. 34 04 303, and U.S. patent application Ser. No. 694,952 filed Jan. 25, 1985.

Figure 2:
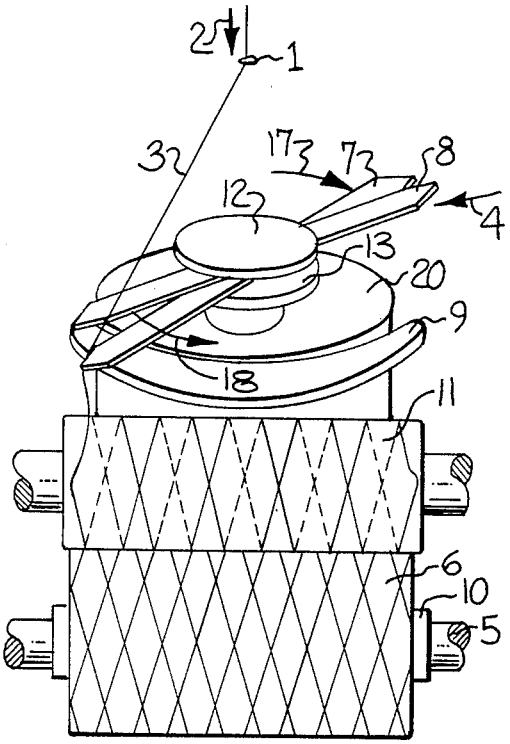
FIG. 2 is a fragmentary front perspective view of the apparatus shown in FIG. 1.

As best seen in FIG. 2, the grooved roller 11 has a series of grooves. In this regard, the depth of the grooves may vary along their course, and the grooves preferably are in the form of a continuous line. Alternatively however, the grooves may be provided only at the ends of the roller.

The grooved roll 11 is driven in common with the rotary guide arms, at a transmission ratio of one to twenty in one preferred embodiment. The law of motion under which the yarn 3 is deposited on the package 6 is substantially predetermined by the course of the grooves. The law of motion under which the yarn is reciprocated by the guide arms 7 and 8 is, as noted above, predetermined by the geometry of the ends of the rotary arms and the guide rail 9. The law of motion is also determined by the circumferential speed of the rotary arms. Further, the yarn may move radially with respect to the rotary arms, in a manner determined by the guide rail. The profile of the ends of the rotary arms, and in particular the slope of the ends, may result in that the yarn moves at an angular velocity which is greater or less than the angular velocity of the arms. By superimposing these possibilities for controlling the direction and rate of movement, any desired law of motion may be produced for the reciprocation of the arm.

Figure 3:
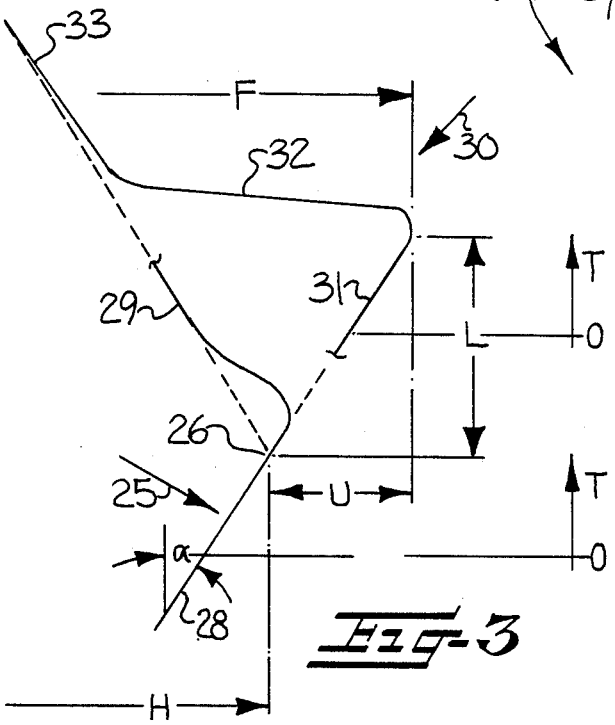
FIG. 3 is a traverse-time graph of the yarn movements.

FIG. 3 illustrates a traverse-time diagram illustrating one embodiment of the yarn movement in accordance with the present invention. The common abscissa of the diagram represents the traverse stroke of the groove roller, or the guide stroke of the first yarn traverse means, and with each of the guide stroke and traverse stroke having its own time ordinate. The ordinates are displaced relative to each other so that two yarn points in the first and second yarn traversing means may be simultaneously viewed, and to illustrate the difference in the stroke lengths, which is represented by U.

The path of the curve 25 as seen in FIG. 3 represents the geometry of the yarn guide groove of the grooved roller on the right end of the traverse stroke H. The theoretical end of the stroke is at 26, which substantially represents the end of the package. The groove is slightly extended beyond this theoretical stroke by the branch 27, so as to take into account the fact that the yarn deposited on the package tends to slide inwardly.

The curved path 30 shows a portion of the law of motion which is imparted to the yarn by the rotary guide arms 7 and 8. As will be apparent, the guide arms 7 and 8 thus defines a guide stroke F which extends beyond each of the ends of the traverse stroke H of the yarn on the package, by the amount U. This difference in stroke lengths is proportional to the distance L, which is the distance between the guide rail 9 or, the rotary planes I, II of the arms, and the contact point on the surface of the grooved roll 11. In addition, the difference between F and H is proportional to the angle alpha, which equals the angle between the yarn deposited on the package and a tangent line which is perpendicular to the axis of the package as shown in FIG. 3. The distance L, which is also referred to as the trailing length, may be practically measured from the centerline between the rotary planes I and II, and equals the shortest distance of yarn travel between such point and the yarn contact point on the roller 11. The angle alpha may also be defined as the angle between the groove of the grooved roll and a perpendicular tangent line to the grooved roll. Referring again to FIG. 3, the yarn is initially guided at a given speed by the arms 7 and 8 along a branch 31 to the end of the guide stroke F, which speed substantially corresponds to the traversing speed of the yarn deposit following the branch 28 of the curved path 25 of the grooved roller, however with a lead substantially corresponding to the distance U. Upon reaching, the end of the guide stroke F, the yarn is decelerated at a hign rate, and its direction of movement reversed so that it returns at a high speed along branch 32 to the area 33, which is substantially aligned with curved branch 29 of the grooved roller, however with the possibility of a small angle of deviation. The course of the stroke 33 of the first yarn traversing means thus corresponds in the central area of the stroke to the yarn deposit 29 after the stroke reversal with a distance related phase displacement, so that at the same points in time, the first traversing means leads the second by substantially the distance U.

Figure 4:
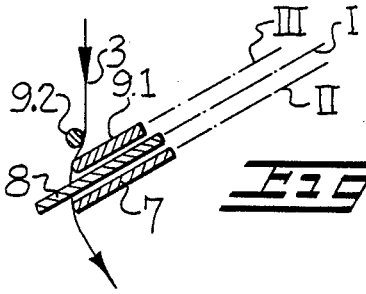
FIG. 4 is an enlarged fragmentary sectional view of the guide rail and extremities of the rotating guide arms of the apparatus shown in FIG. 1.

In accordance with the present invention, the high rate of deceleration or acceleration of the yarn at the end of the guide stroke is provided either by a forced guidance of the yarn, or a release of the yarn. In the embodiment illustrated in FIGS. 4 and 5, the yarn is reversed at the ends of the guide stroke F between a first guide rail 9.1 and a second curved guide rail 9.2, with the two guide rails overlying each other on opposite sides of the yarn path, note FIG. 4. The two guide rails 9.1 and 9.2 thus define a relatively short initial traverse distance E from the end of the stroke toward the center of the stroke and a distinct second traverse distance (B minus E) which is adjacent the initial traverse stroke and wherein the two guide rails overlap each other in plan view.

Figure 5:
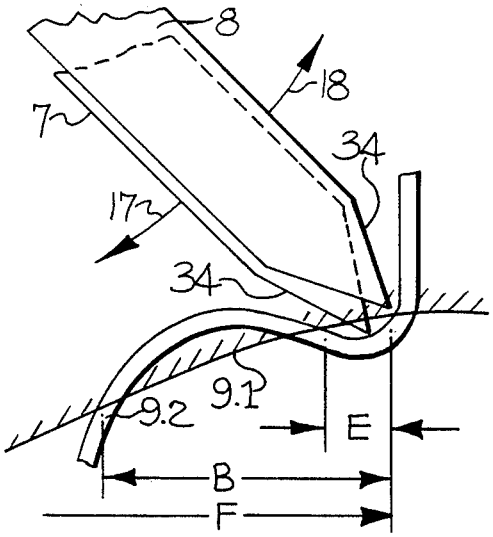
FIG. 5 is a fragmentary plan view of the guide rail and guide arms as shown in FIG. 4.

FIG. 5 illustrates a moment shortly after the moment in which the front tip of the rotary guide arm 8 leaves the stroke area and has moved under the guide rail 9.1 and released the yarn. Prior to this moment, the leading edge 34 of the rotary guide arm 7 moving into the traverse stroke has not yet emerged from under the guide rail 9.1. Thus, the yarn has reached the end of the outward traversing motion, and is without guidance or contact with the arms. Therefore, by reason of its tension, the yarn is essentially free to move or rebound toward the center of the stroke. Along the distance E, the yarn is essentially free to move toward the center of the stroke, and this rebound is not impeded by the guide rails 9.1 and 9.2, since there is no, or only a very slight overlap along this distance. The speed of the free rebound depends on the yarn tension, and the free mobility of the yarn permits the yarn to rapidly decelerate and accelerate in the opposite direction, and so that along the distance E a law of motion is obtained which approximately corresponds to curved branch 32 under the law of motion at 30 of FIG. 3. In the second traverse distance wherein the guide rails 9.1 and 9.2 overlap, and as represented by the distance B minus E, the rebound motion is restrained, so that the leading edge 34 of the guide arm 7 and which emerges above the guide rail 9.1, can catch up with the yarn and engage the yarn in its movement toward the left as seen in FIG. 5. Thereafter the yarn is again forceably guided by the leading edge 34 of the rotary arm 7 under a predetermined law of motion and corresponding to the curved branch 33 illustrated in FIG. 3.

In the drawings and specification, there has been set forth a preferred embodiment of the invention, and although specific terms are employed, they are used in a generic and descriptive sense only and not for purposes of limitation.

That which is claimed is:

1. In a yarn winding apparatus comprising a spindle adapted to coaxially mount a tubular yarn bobbin, drive means for rotating the yarn bobbin and a yarn package being formed thereon, first yarn traverse means comprising a guide rail extending in a direction generally parallel to the axis of said spindle and a pair of guide arms mounted for rotation in opposite directions about closely adjacent or coaxial axes and so that the rotating arms define closely adjacent parallel planes and the extremity of each rotating arm is adapted to pass through the running yarn path of travel and along the guide rail and so as to reciprocate the yarn along a guide stroke, and second yarn traverse means comprising a guide roller mounted between said first yarn traverse means and said spindle and generally parallel to the axis of said spindle, said guide roller having grooves formed in the surface thereof for guiding the running yarn onto a yarn bobbin mounted on said spindle and while traversing the yarn along a traverse stroke to form a cross wound yarn package, the improvement wherein said first yarn traverse means is constructed and arranged such that said guide stroke extends beyond each of the ends of said traverse stroke defined by said guide roller.

2. In a yarn traverse apparatus as defined in claim 1 wherein said first yarn traverse means further comprises means for guiding the yarn adjacent each of the ends of said guide stroke such that the yarn advances along a relatively short initial traverse distance from the end of said stroke toward the center of the stroke at a speed greater than the advance speed along the remainder of said stroke.

3. In a yarn traverse apparatus as defined in claim 2 wherein said means for guiding the yarn adjacent each of the ends of the traverse stroke is constructed such that the yarn is released from any positive guidance by said pair of guide arms during movement of said yarn through said initial traverse distance.

4. In a yarn traverse apparatus as defined in claim 1 wherein said first yarn traverse means further comprises means for guiding the yarn adjacent each of the ends of the guide stroke so as to define a relatively short initial traverse distance from the end of the stroke toward the center of the stroke wherein the yarn is released from any positive guidance and is essentially free to move toward the center of the stroke, and a distinct second traverse distance which is adjacent said initial traverse distance and wherein the yarn is restrained in such movement.

5. In a yarn traverse apparatus as defined in claim 4 wherein said guide rail is disposed on one side of the running yarn, and said means for guiding the yarn adjacent each of the ends of the guide stroke comprises said guide rail and a further guide rail disposed on the other side of the running yarn, and with said two guide rails overlapping each other in plan view along at least said second traverse distance, and with any overlap along said short initial traverse distance being less than the overlap along said second traverse distance.

6. In a yarn traverse apparatus as defined in claim 5 wherein said further guide rail is arcuately curved along its length.

7. In a yarn traverse apparatus as defined in any one of claims 1–3 wherein said guide rail and said pair of guide arms are constructed and arranged such that said guide stroke extends beyond each of the ends of said traverse stroke by an amount equal to at least about L times tangent alpha, wherein L equals the shortest distance of yarn travel between said pair of guide arms and the yarn contact point on said guide roller, and alpha equals the angle between the yarn on the package and a tangent line perpendicular to the axis of the package.

8. In a yarn traverse apparatus as defined in any one of claims 1–3 further comprising common drive means for rotating said pair of guide arms and said roller, with said common drive means being separate from said drive means for rotating the bobbin and package being formed on said spindle.

* * * * *